US010267304B2

(12) United States Patent
Reif et al.

(10) Patent No.: US 10,267,304 B2
(45) Date of Patent: Apr. 23, 2019

(54) HOSE SYSTEM

(75) Inventors: Oscar-Werner Reif, Hannover (DE); Paul Priebe, Smithtown, NY (US)

(73) Assignee: SARTORIUS STEDIM BIOTECH GMBH, Goettingen (DE)

( * ) Notice: Subject to any disclaimer, the term of this patent is extended or adjusted under 35 U.S.C. 154(b) by 161 days.

(21) Appl. No.: 12/828,450

(22) Filed: Jul. 1, 2010

(65) Prior Publication Data

US 2011/0014075 A1 Jan. 20, 2011

(30) Foreign Application Priority Data

Jul. 15, 2009 (DE) ..... 10 2009 033 401

(51) Int. Cl.
*F04B 43/12* (2006.01)

(52) U.S. Cl.
CPC ..... *F04B 43/1261* (2013.01)

(58) Field of Classification Search
USPC ..... 417/474, 477.1, 477.12
See application file for complete search history.

(56) References Cited

U.S. PATENT DOCUMENTS

| | | | | |
|---|---|---|---|---|
| RE27,376 | E * | 5/1972 | Pickup | 417/477.12 |
| 5,318,413 | A | 6/1994 | Bertoncini | |
| 5,388,972 | A | 2/1995 | Calhoun et al. | |
| 7,980,835 | B2 * | 7/2011 | LaBanco et al. | 417/477.12 |

FOREIGN PATENT DOCUMENTS

| | | |
|---|---|---|
| DE | 195 02 032 | 7/1995 |
| EP | 1 400 691 | 7/2007 |

* cited by examiner

*Primary Examiner* — Patrick Hamo
(74) *Attorney, Agent, or Firm* — Gerald E. Hespos; Michael J. Porco; Matthew T. Hespos

(57) ABSTRACT

A hose system has a pump hose with a hose portion insertable into a pump head of a hose pump. The hose portion has at least a first stop element fixing the hose portion in the feed direction. The first stop element can subsequently be connected immovably to the pump hose at a predefinable position of the pump hose. Thus, the pump hose can be used more universally and can be adapted to different pump heads.

15 Claims, 3 Drawing Sheets

HOSE SYSTEM

BACKGROUND OF THE INVENTION

1. Field of the Invention

The invention relates to a hose system with a pump hose which has a hose portion insertable into a pump head of a hose pump and which has at least a first stop element fixing the hose portion in the feed direction.

2. Description of the Related Art

Hose pumps with a peristaltic feed action often are used in biotechnology, pharmacy and medicine, particularly in connection with disposable products.

U.S. Pat. No. 5,388,972 A and EP 1 400 691 B1 use a roller pump and employ stop elements on the input and output sides to avoid a "migration" of the pump hose. Each stop element is fit in corresponding recesses of the pump head. These systems disadvantageously can be used only with specific pump hoses and their stop elements are adapted to a defined pump.

U.S. Pat. No. 5,318,413 A discloses a peristaltic pump in the pump hose of which the recess for one of two stoppers is mechanically adjustable. Different hoses with varying stopper distances can be inserted into the pump head. However, the mechanical adjustment is complicated and cost-intensive. Moreover, a defined pump or a defined pump head has to be used.

DE 195 02 032 A1 also discloses a peristaltic pump with a pump hose that has stop elements fit on the input side and output side in support devices or support recesses. This case also disadvantageously requires pump hoses adapted to the pump.

The object of the invention is to improve the known pump hoses so that they can be used more universally and can be adapted to different pump heads.

SUMMARY OF THE INVENTION

The invention relates to a hose system with a pump hose with a hose portion that is insertable into a pump head of a hose pump. The pump hose has at least a first stop element for fixing the hose portion in the feed direction. The first stop element can subsequently be connected immovably to the pump hose at a predefinable position of the pump hose. Thus, the pump hose can be incorporated in a disposable system and can be fit in different pump heads. The predefinable position of the stop element also means that the site of application of the pump on the length of the pump hose is relatively variable.

A second stop element may be provided so that a distance from the first stop element can be adjusted by moving at least the first stop element. The second stop element may be pre-installed on the pump hose in a fixed position. However, the first stop element can be moved to adapt the distance between the two stop elements to the particular pump head. Alternatively, the second stop element can be pre-installed movably and can be brought to a fixed position. Thus, both stop elements can be moved on the pump hose and brought to predefinable positions so that the distance between the two stop elements can be adapted to the pump head.

The first stop element can be movably pre-installed.

The pre-installation of the movable stop elements advantageously enables the pump hoses to be incorporated in a complete system that may comprise the entire pump hose and stop elements do not have to be plugged on from the side.

The first stop element preferably is positioned on the input side upstream of the pump head.

The second stop element preferably can be arranged downstream of a first lock of the pump head on which the first stop element abuts or can be positioned on the output side downstream of the pump head. Positioning the second stop element on the output side enables the pump to be operated in two feed directions.

The movable stop element preferably is designed to be locked with the pump hose.

The circumference of pump hose may have locking indents that can engage a resilient shoulder or a locking lip of the stop element with a locking action. Alternatively, the movable stop element can be fixed on the pump hose by adhesive bonding. The movable stop element can have an adhesive layer toward the surface of the pump hose. The adhesive layer may be activatable by external influence, such as heat or UV light.

The pump hose may have has a surface area that is suitable for a hook-and-loop fastener and on which a hook-and-loop tape forming an abutment for the movable stop element can be secured. However, the hook-and-loop tape can also be secured both on the pump hose and also on a shoulder of the stop element and can fix the stop element in both directions.

The surface of the stop element directed toward the pump hose may be made slip-resistant. A slip-resistant design of this kind can support the fixing on the pump hose.

The second stop element may be applied to the pump hose in an overmolding process or an insert molding process. An overmolding or insert molding process enables the pump hose to be encapsulated by a second material component, for example a harder plastic, which then forms the second stop element.

The hose system of the invention can be used particularly advantageously in disposable pre-sterilizable filtration systems or disposable pre-sterilizable container systems, such as the system disclosed in DE 10 2008 015 387.7, the disclosure of which is incorporated herein by reference. In this case a hose pump can be mounted at variable positions of the filtration or container system using the stop elements, e.g. upstream or downstream of a filtration device or upstream or downstream of a fluid-filled container for mixing, storing and/or transferring media and for carrying out chemical and physical processes.

Further features of the invention will become clear from the following detailed description and from the attached drawings in which preferred embodiments of the invention are illustrated by way of example.

DETAILED DESCRIPTION OF THE PREFERRED EMBODIMENTS

Figure 1:
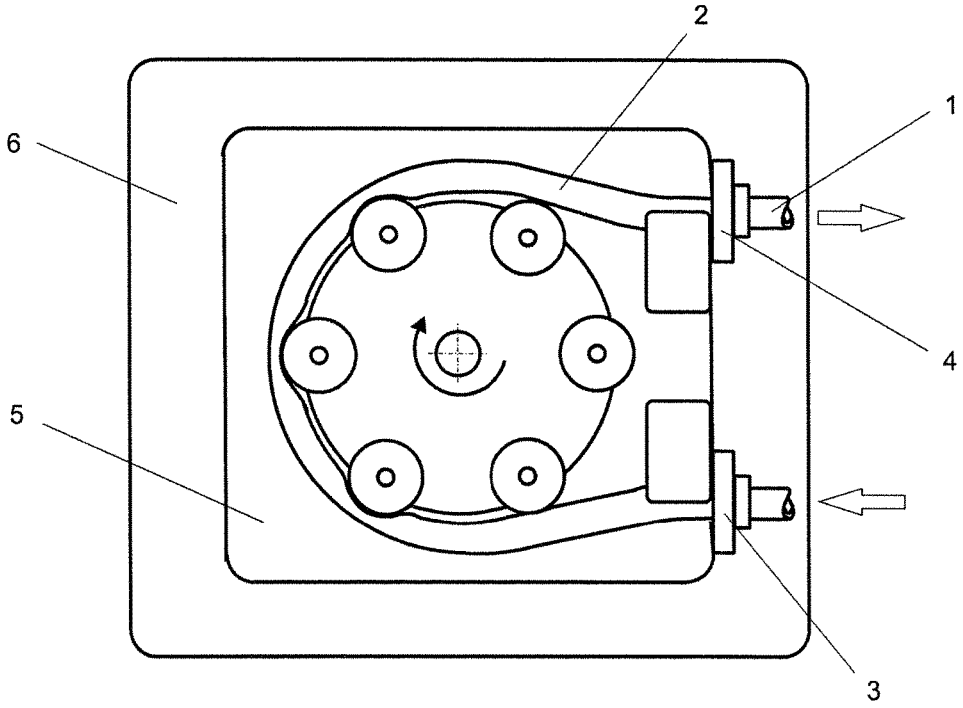
FIG. 1 is a front view of a pump with pump head and inserted pump hose.

A hose system is composed principally of a pump hose 1 with a hose portion 2, a first stop element 3 and a second stop element 4.

The pump hose 1 can be inserted with its hose portion 2 into a pump head 5 of a hose pump 6.

Figure 2:
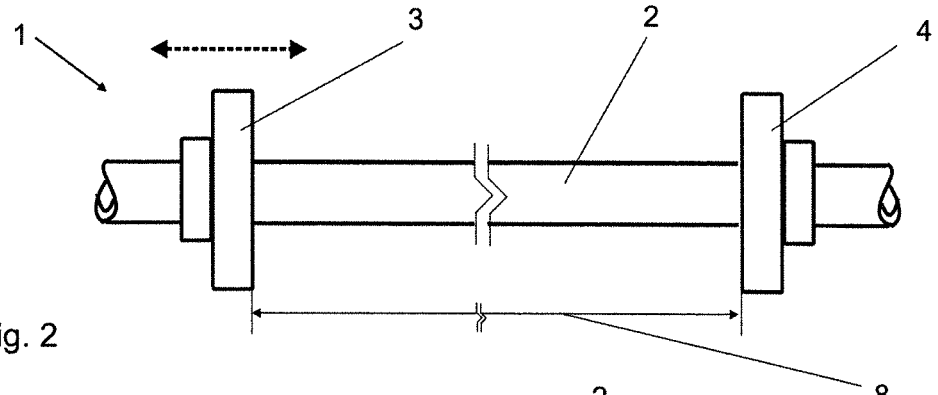
FIG. 2 is a side view of the pump hose from FIG. 1 in an enlarged and extended representation.

The first stop element 3 is arranged movably on the hose portion 2 and can be connected immovably to the pump hose 1 at a predefinable position. According to the embodiment in FIG. 2, the second stop element 4 also is arranged longitudinally movably on the pump hose 1 and can be fixed immovably on the pump hose 1 like the first stop element 3.

Figure 3:
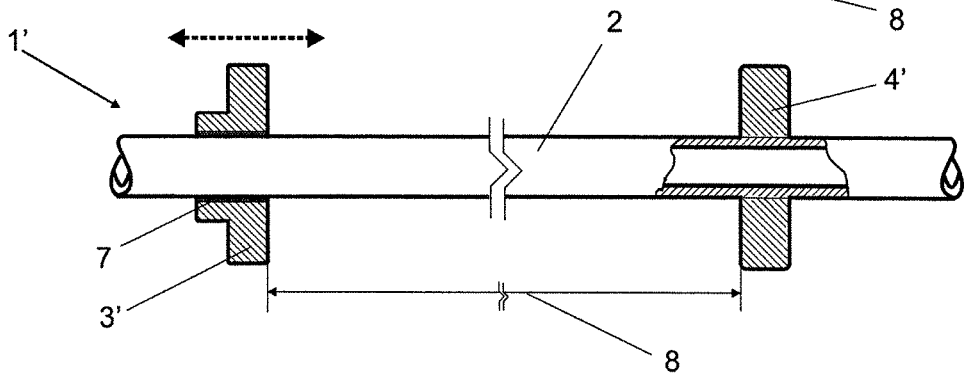
FIG. 3 is a side view of an extended pump hose with a longitudinally movable first stop element that has an activatable adhesive layer, and with an encapsulated second stop element partially in section.

According to the embodiment in FIG. 3, the first stop element 3' has an adhesive layer 7 that can be activated by an external influence, and the first stop element 3' is fixed immovably on the pump hose 1. According to the illustrative embodiment in FIG. 3, the second stop element 4' is applied to the pump hose by encapsulation in an overmolding or insert molding process and thus pre-installed in a fixed position. The first stop element 3' can be moved so that the distance 8 between the two stop elements 3', 4' can be adapted to the particular pump head, and the first stop element 3' then can be fixed.

Figure 4:
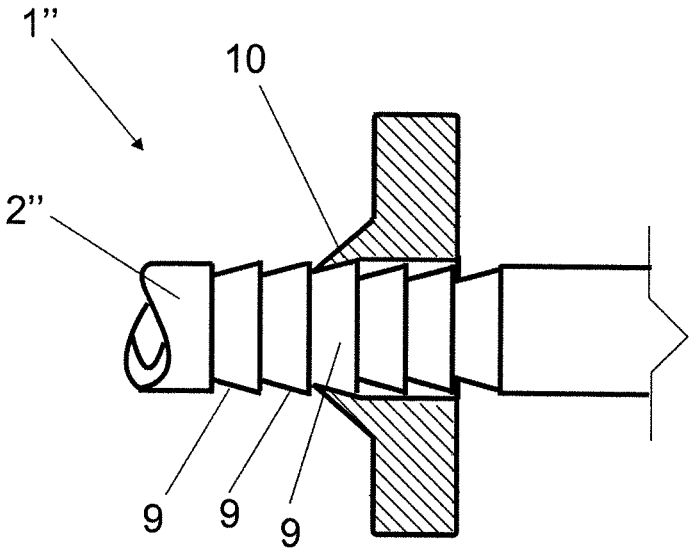
FIG. 4 is a portion of a pump hose with locking indents and a lockable first stop element in section.

According to the embodiment in FIG. 4, the pump hose 1" or the hose portion 2" has locking indents 9 into which a locking lip 10 of the first stop element 3" engages with a locking action.

Figure 5:
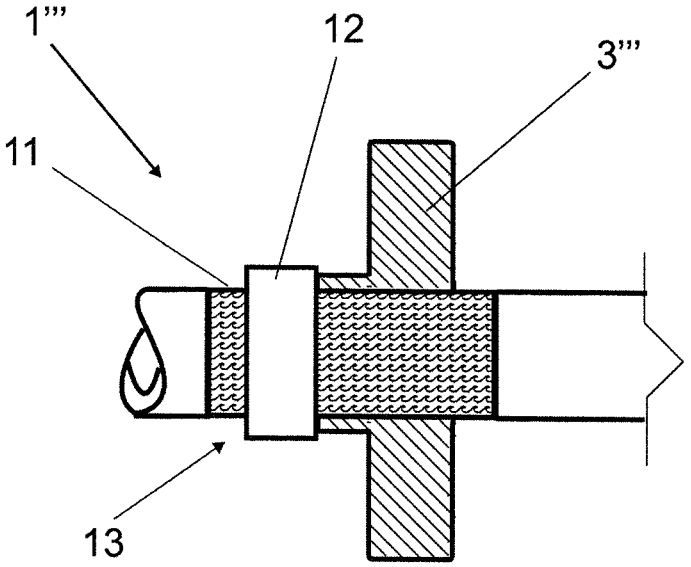
FIG. 5 is a side view of a pump hose portion with a first stop element in section and with a hook-and-loop fastener.

FIG. 5 shows an illustrative embodiment in which the pump hose 1''' has a surface area 11 that is suitable for a hook-and-loop fastener 13 and on which a hook-and-loop tape 12 can be secured. The hook-and-loop tape forms a fixing abutment for the stop element 3'''.

What is claimed is:

1. A hose system with a pump hose (1, 1', 1", 1''') that has a hose portion (2) insertable into a pump head (5) of a hose pump (6) and at least a first stop element (3, 3', 3", 3''') fixing the hose portion (2) in a feed direction, the first stop element (3, 3', 3", 3''') being connectable immovably to the pump hose (1, 1', 1", 1''') at a predefinable position of the pump hose and an input side upstream of the DUMP head (51, a second stop element (4, 4') on the pump hose (1, 1'), the second stop element (4) being arranged downstream of a locking device of the pump head (5) on which the first stop element abuts, a distance (8) of the second stop element (4, 4') from the first stop element (3, 3') being adjustable by moving at least one of the first stop element (3, 3') and the second stop element (4, 4').

2. The hose system of claim 1, wherein the second stop element (4') is pre-installed on the pump hose (1') in a fixed position.

3. The hose system of claim 1, wherein the second stop element (4) is pre-installed movably on the pump hose (1) and can be brought to a fixed position.

4. The hose system of claim 1, wherein the first stop element (3, 3', 3", 3''') is pre-installed movably.

5. The hose system of claim 1, wherein the second stop element (4) is positioned on an output side downstream of the pump head (5).

6. The hose system of claim 1, wherein the movable stop element (3") can be locked with the pump hose (2").

7. The hose system of claim 1, wherein the movable stop element (3') can be fixed on the pump hose (1') by an adhesive bond.

8. The hose system of claim 7, wherein the movable stop element (3') has an adhesive layer (7) that is activatable by an external influence.

9. The hose system of claim 8, wherein the adhesive layer (7) is activatable by heat.

10. The hose system of claim 1, further comprising a hook-and-loop fastener (10) on a surface area (11) of the pump hose (1''') and hook-and-loop tape (12) secured on the movable stop element (3") for attachment to the hook-and-loop fastener (10).

11. The hose system of claim 1, wherein the movable stop element (3) is made slip-resistant on the surface thereof directed toward the pump hose (1).

12. The hose system of claim 2, wherein the second stop element (4) is applied to the pump hose (1') in an overmolding process or an insert molding process.

13. A pump system for a disposable pre-sterilizable filtration systems or a disposable pre-sterilizable container system, comprising:

a hose pump (6) having a pump head (5); and a pump hose (1, 1', 1", 1''') that has a hose portion (2) insertable into the pump head (5), the pump hose (1, 1', 1", 1''') further having a first stop element (3, 3', 3", 3''', and a second stop element (4, 4') thereon, at least the first stop element (3, 3', 3", 3''') being movable along the hose portion (2) and including means for fixing the first stop element (3, 3', 3", 3''') at a selected position on the hose portion (2), the first stop element (3, 3', 3", 3''') and the second stop element (4, 4') being configured for preventing movement of the hose portion (2) relative to the pump head (5) in a feed direction wherein the first stop element (3) is positioned on an input side upstream of the pump head (5) and the second stop element (4) is arranged on a downstream of a locking device of the pump head (5) on which the first stop element abuts.

14. The pump system of claim 13, wherein the second stop element (4) is positioned on an output side downstream of the pump head (5).

15. The pump system of claim 13, wherein the means for fixing the first stop element (3') is an adhesive layer (7) that is activatable by an external influence.

* * * * *